US009620320B2

(12) United States Patent
Nakahara et al.

(10) Patent No.: US 9,620,320 B2
(45) Date of Patent: Apr. 11, 2017

(54) CONTACT DEVICE

(71) Applicant: Panasonic Intellectual Property Management Co., Ltd., Osaka (JP)

(72) Inventors: Chiharu Nakahara, Mie (JP); Kazuhisa Kinoshita, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/710,355

(22) Filed: May 12, 2015

(65) Prior Publication Data

US 2015/0325398 A1 Nov. 12, 2015

(30) Foreign Application Priority Data

May 12, 2014 (JP) ..... 2014-098935

(51) Int. Cl.
*H01H 50/64* (2006.01)
*H01H 50/58* (2006.01)
*H01H 50/18* (2006.01)

(52) U.S. Cl.
CPC ..... *H01H 50/58* (2013.01); *H01H 50/18* (2013.01); *H01H 50/642* (2013.01)

(58) Field of Classification Search
CPC ..... H01H 50/642
USPC ..... 335/78–86
See application file for complete search history.

(56) References Cited

U.S. PATENT DOCUMENTS 5,392,015 A * 2/1995 Matsuoka ..... H01H 50/642 335/130
5,757,255 A 5/1998 Noda et al.
5,969,586 A 10/1999 Noda et al.
8,193,881 B2 * 6/2012 Yuba ..... H01H 9/443 335/128
2009/0115557 A1 5/2009 Minowa et al.

FOREIGN PATENT DOCUMENTS

EP 0751544 A1 1/1997
EP 0751544 A1 7/1997
JP 2009-146759 A 7/2009

OTHER PUBLICATIONS

European Search Report dated Oct. 13, 2015 issued in Application No. 15167300.1.

* cited by examiner

*Primary Examiner* — Ramon M Barrera
(74) *Attorney, Agent, or Firm* — McDermott Will & Emery LLP

(57) ABSTRACT

The contact device includes an armature, a driver, a fixed contact, a movable contact, a contact spring, and a card. The driver drives the armature. The movable contact is to be in contact with and separate from the fixed contact. The contact spring is for holding the movable contact so as to allow the movable contact to be in contact with and separate from the fixed contact. The card interconnects the armature and the contact spring. The card is made of resilient material and fixed to each of the armature and the contact spring.

6 Claims, 18 Drawing Sheets

CONTACT DEVICE

CROSS-REFERENCE TO RELATED APPLICATIONS

The application is based upon and claims the benefit of priority of Japanese Patent Application No. 2014-98935, filed on May 12, 2014, the entire contents of which are incorporated herein by reference.

TECHNICAL FIELD

The present invention generally relates to contact devices and in particular relates to a contact device such as an electromagnetic relay.

BACKGROUND ART

Document 1 (e.g., JP 2009-146759 A) discloses an electromagnetic relay exemplifying a conventional example. In this conventional example, an electromagnetic device (driver) and a contact mechanism are attached to a body. The electromagnetic device is configured to drive a card by swinging an armature in order to open and close the contact mechanism.

The card is engaged with the armature by inserting an end of the armature into an insertion hole of the card. Further, a movable spring is engaged with the card by inserting an end of the movable spring into another insertion hole of the card. The swinging of the armature causes a straight movement of the card, and this drives the movable spring.

In the conventional example disclosed in document 1, when the movable spring is driven via the card, the ends of the armature and the movable spring slide inside the insertion holes of the card, and as a result abrasion powder may occur. When such abrasion powder adheres to the movable contact or the fixed contact, incomplete contact or the like may occur, and this results in a decrease in the reliability.

SUMMARY OF INVENTION

In view of the above insufficiency, the present invention has aimed to improve reliability.

The contact device of one aspect of the present invention includes: an armature; a driver for driving the armature; a fixed contact; a movable contact to be in contact with and separate from the fixed contact; a contact spring for holding the movable contact so as to allow the movable contact to be in contact with and separate from the fixed contact; and a card interconnecting the armature and the contact spring. The card is made of resilient material and fixed to each of the armature and the contact spring.

DESCRIPTION OF EMBODIMENTS

Hereinafter, the contact device (electromagnetic relay) of one embodiment in accordance with the present invention is described in detail with reference to attached drawings. Note that, the contact device of the present invention is not limited to the present embodiment, and may have various configurations within the technical scope of the present invention. Unless otherwise noted, the following descriptions are made based on forward and rearward, left and right, and upward and downward directions defined in FIG. 2.

Figure 1:
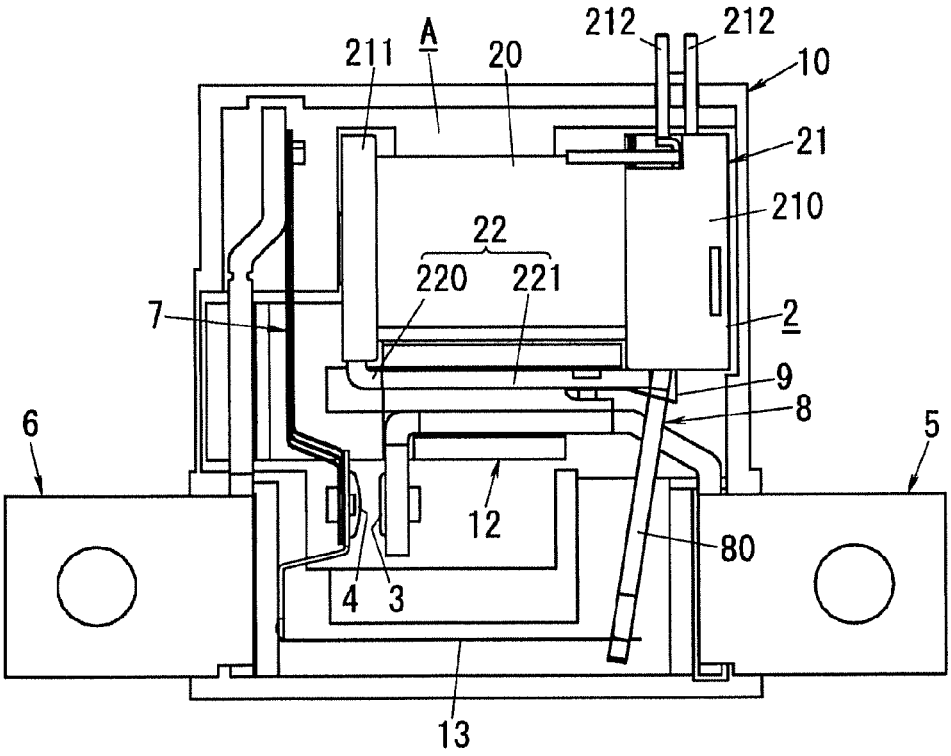
FIG. 1 is a plan illustrating the contact device of one embodiment in accordance with the present invention without the cover.
Figure 2:
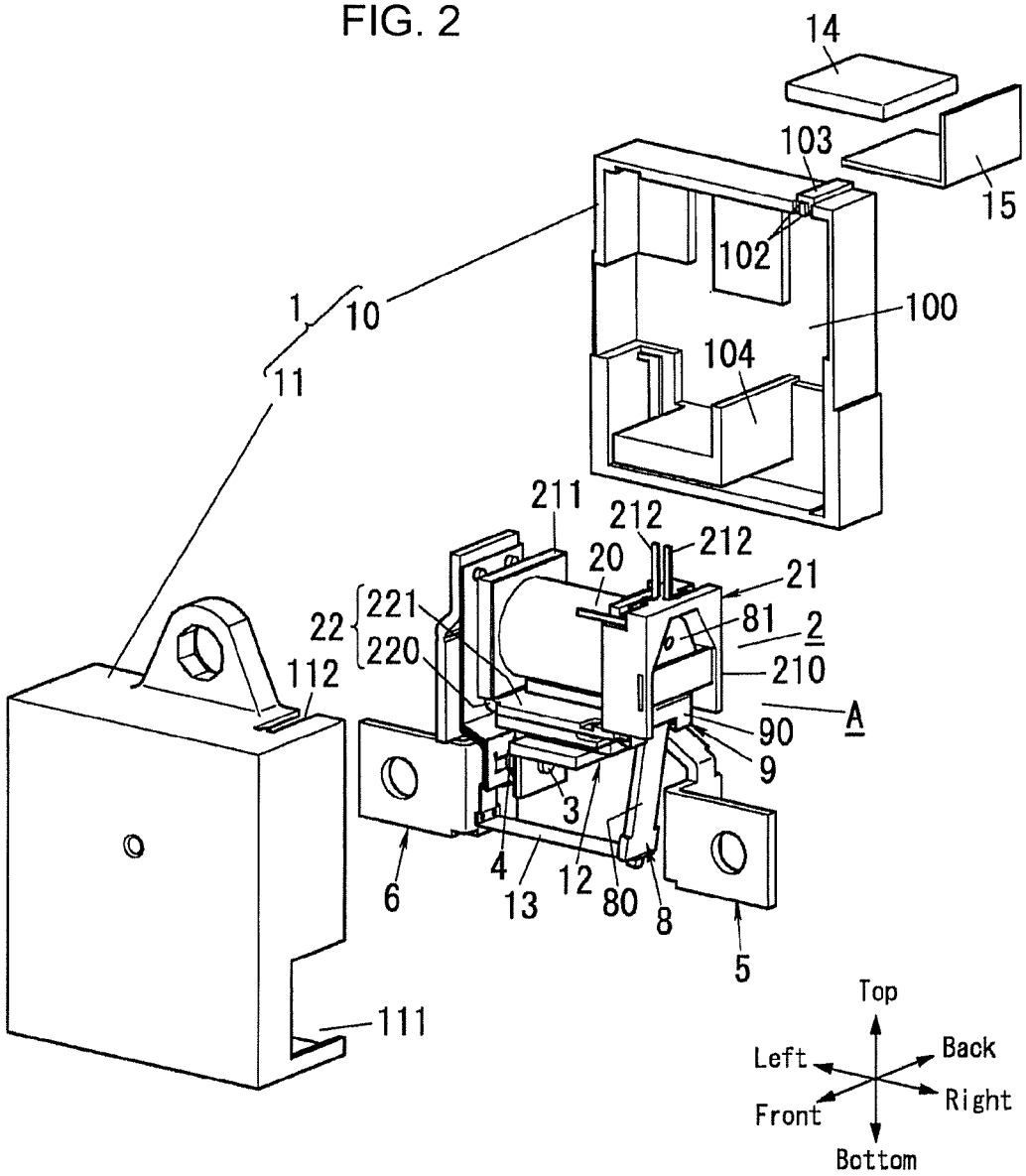
FIG. 2 is an exploded perspective view illustrating the contact device of the embodiment in accordance with the present invention.
Figure 3:
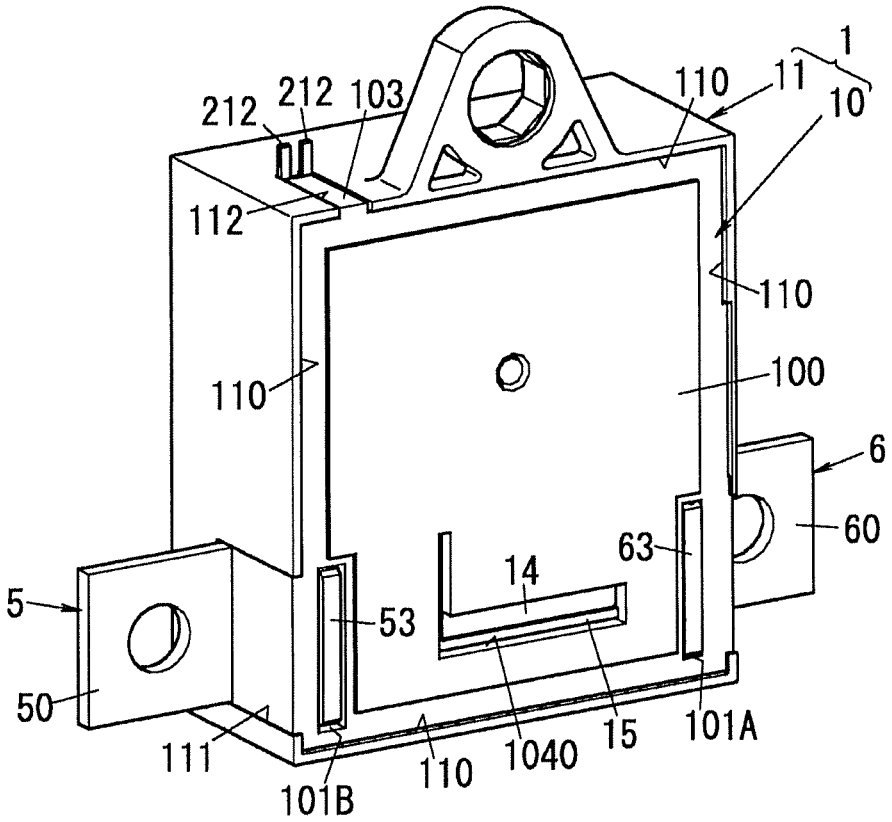
FIG. 3 is a perspective view illustrating the rear side of the contact device of the embodiment in accordance with the present invention.

As shown in FIG. 1 to FIG. 3, the contact device of the present embodiment (hereinafter, abbreviated as "contact device") includes a case (outer casing) 1 constituted by a body 10 and a cover 11. The body 10 is a synthetic resin molded product in a rectangular box shape with an open face. The cover 11 is a synthetic resin molded product in a rectangular box shape with an open face. The case 1 is assembled by covering the body 10 with the cover 11.

Note that, there is a tiny flange 110 protruding inward from the almost entire periphery of an opening of the cover 11. The bottom of the body 10 is caught by the flange 110, and therefore the body 10 and the cover 11 are coupled so that separation of the body 10 and the cover 11 is prevented (see FIG. 3). Alternatively, a coupling method allowing prevention of separation is not limited to the above method. For example, instead of providing the flange 110, the body 10 and the cover 11 may be coupled with adhesive (sealant).

Further, the contact device of the present embodiment includes a relay body A which is constituted by a driving block, a contact block, and a positioning member 12 and is situated in the case 1.

The driving block includes a driver 2, an armature 8, a hinge spring 9, and a card 13. The driver 2 is an electromagnet including a bobbin 21, a coil 20 formed by winding a wire around the bobbin 21, an iron core situated in a center of the bobbin 21, and a heel piece 22.

The bobbin 21 includes a barrel inside the coil 20, a first flange 210 provided to one axial end of the barrel, and a second flange 211 provided to the other axial end of the barrel. Note that, in this bobbin 21, it is preferable that the barrel and the pair of flanges 210 and 211 be formed integrally by use of insulating material such as synthetic resin.

The first flange 210 is in a flat rectangular box shape with one open bottom (right side) and one open side (lower face) (see FIG. 2). There is a pair of coil terminals 212 protruding outward (upward) in a diameter direction of the barrel from a side (upper face) of the first flange 210. The pair of coil terminals 212 are individually connected to both ends of the coil 20. When a voltage is applied between the pair of coil terminals 212 and 212, current flows through the coil 20 and therefore the driver (electromagnet) 2 is excited.

The heel piece 22 is in an L-shape, and includes a holding piece 220 held by the second flange 211, and a main piece 221 extending from an end of the holding piece 220 to the first flange 210 which are formed integrally by use of magnetic material (see FIG. 1).

The armature 8 includes a driving piece 80 in a band plate shape, and a supporting piece 81 which is in a flat plate shape and is wider than the driving piece 80. The driving piece 80 and the supporting piece 81 are formed integrally by use of magnetic material. The supporting piece 81 is accommodated in the first flange 210, and is fixed to a first fixing piece 90 of the hinge spring 9 (see FIG. 2 and FIG. 6). Further, the supporting piece 81 faces an end of the iron core exposed on an inner bottom of the first flange 210.

The driving piece 80 protrudes to an outside of the first flange 210 through the open side (lower face) of the first flange 210. Further, the driving piece 80 abuts on a front end of the main piece 221 of the heel piece 22 (see FIG. 4). Note that, there is a projection 82 in a cuboidal shape provided to a front end face (lower end face) of the driving piece 80.

The hinge spring 9 includes the first fixing piece 90, a second fixing piece 91, and a pair of spring pieces 92. The first fixing piece 90, the second fixing piece 91, and the pair of spring pieces 92 are formed integrally by use of a plate spring (see FIG. 6). The first fixing piece 90 is in a rectangular flat plate shape and is fixed (swaged) to the supporting piece 81 of the armature 8. The second fixing piece 91 is in a rectangular flat plate shape, and is fixed (swaged) to the main piece 221 of the heel piece 22. The pair of spring pieces 92 each are in an L-shape, and include opposite ends in a length direction coupled to the first fixing piece 90 and the second fixing piece 91, respectively.

When the armature 8 is driven by the driver 2, the armature 8 turns around a fulcrum defined by a part of the armature 8 in contact with the main piece 221 of the heel piece 22, in a direction (counterclockwise in FIG. 1) in which the supporting piece 81 moves close to the iron core. When the armature 8 is not driven by the driver 2, the armature 8 turns in a direction (clockwise in FIG. 1) in which the supporting piece 81 moves away from the iron core.

The contact block includes a fixed contact 3, a movable contact 4, a first terminal 5, a second terminal 6, and a contact spring 7.

Figure 4:
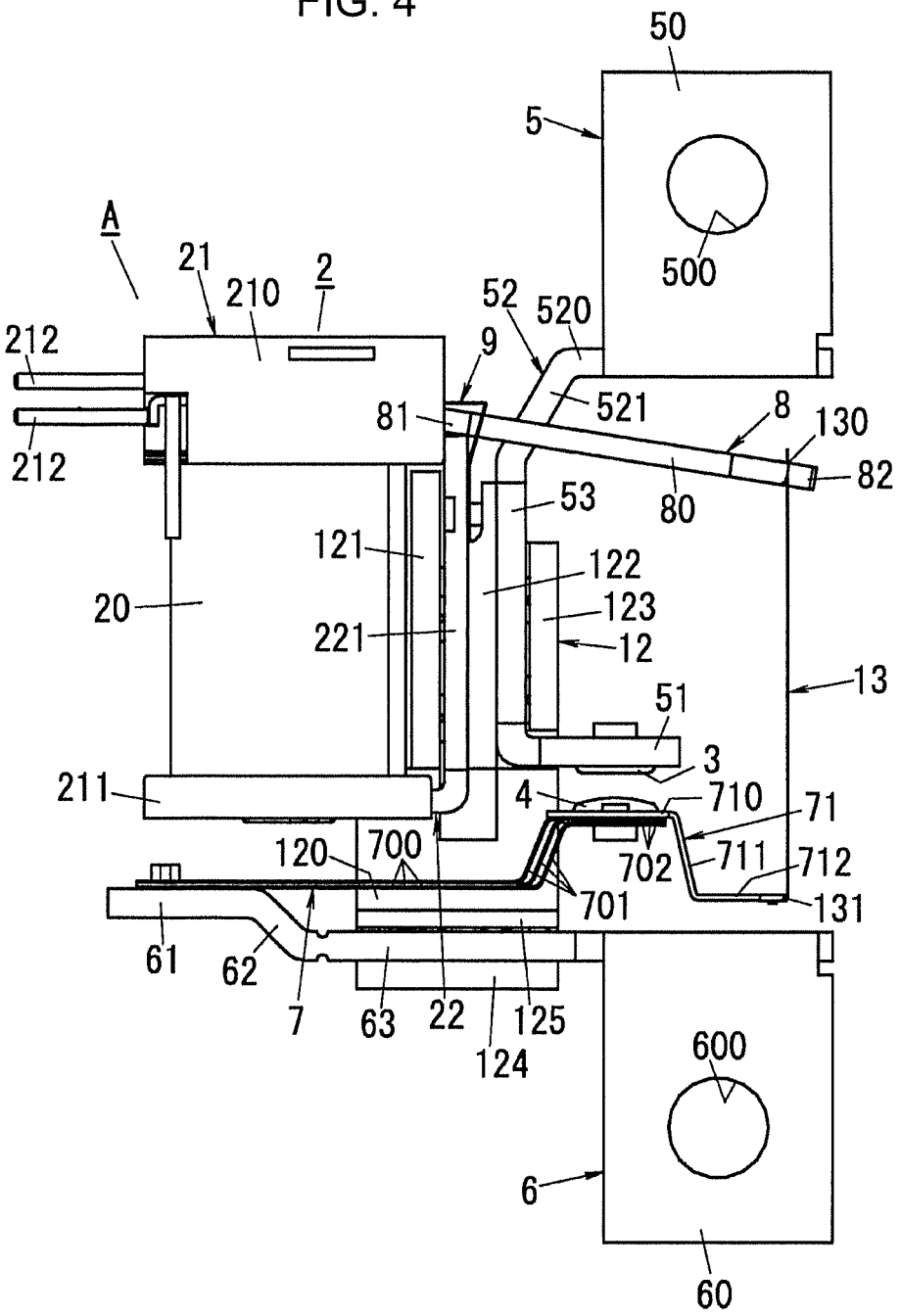
FIG. 4 is a front view illustrating the relay body of the contact device of the embodiment in accordance with the present invention.
Figure 6:
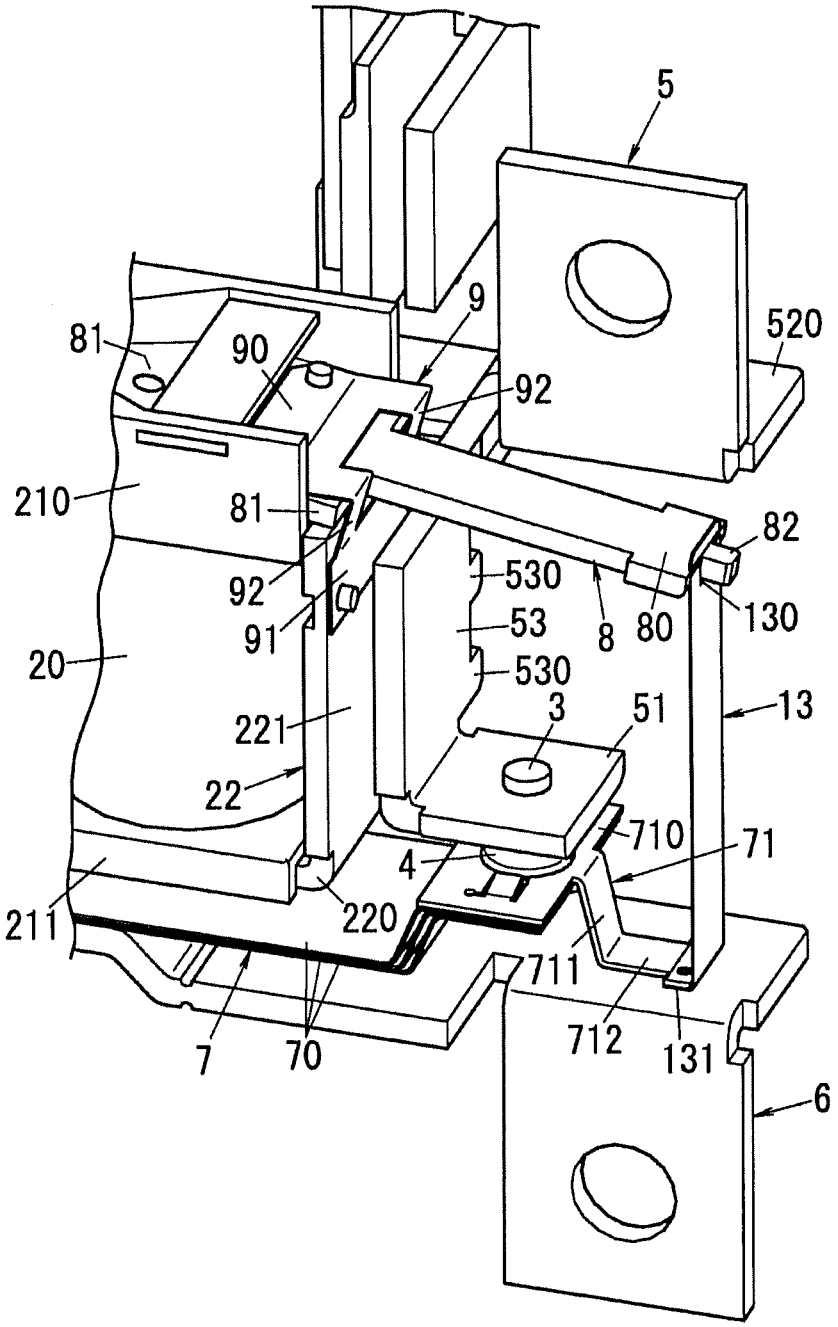
FIG. 6 is a partial perspective view illustrating the relay body of the contact device of the embodiment in accordance with the present invention.
Figure 7D:
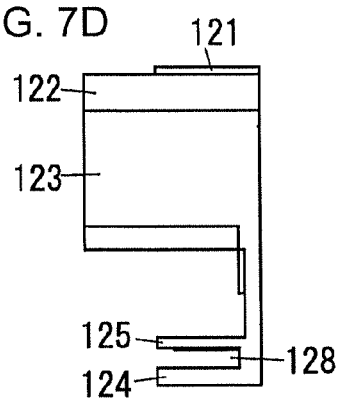
FIG. 7A, FIG. 7B, FIG. 7C, FIG. 7D, FIG. 7E, and FIG. 7F are front, left side, right side, top, bottom, and rear views of the positioning member of the contact device of the embodiment in accordance with the present invention, respectively.
Figure 7B:
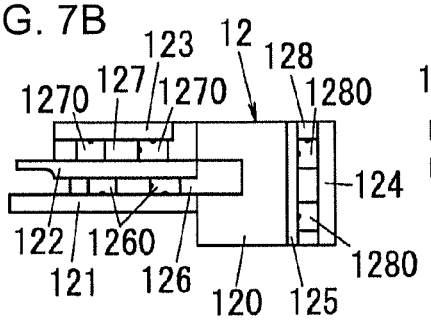
Figure 7A:
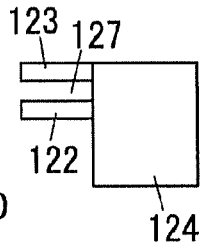
Figure 7C:
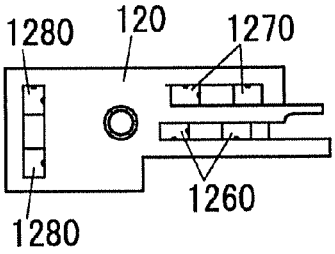
Figure 7E:
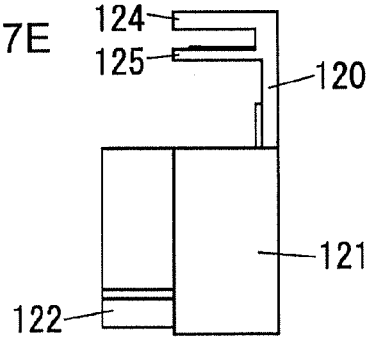
Figure 7F:
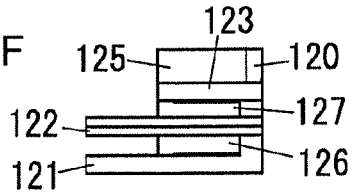

The contact spring 7 includes multiple (three in the present embodiment) plate springs 70 and an interconnection member 71 (see FIG. 4). The plate spring 70 includes a main piece 700 in a band shape, an inclined piece 701 extending obliquely from a front end (lower end) of the main piece 700, and an attachment piece 702 in a rectangular shape protruding from a front end (lower end) of the inclined piece 701 in parallel with the main piece 700. As shown in FIG. 6, these three plate springs 70 are coupled with each other so that the main pieces 700 are in a stack and the attachment pieces 702 are in a stack.

The interconnection member 71 includes an attachment part 710 in a rectangular shape, an inclined part 711 protruding obliquely downward from a center of a lower end of the attachment part 710, and a connection part 712 extending from a front end (lower end) of the inclined part 711 in parallel with the attachment part 710 (see FIG. 4).

The attachment part 710 is situated on the attachment pieces 702 of the plate springs 70. The movable contact 4 is provided to a surface (right side) of the attachment part 710 so as to penetrate through the three attachment pieces 702 and the attachment part 710. Further, in the connection part 712, a front end (lower end) part is wider than a remaining part. The connection part 712 is coupled to the card 13 at the wide front end part.

Further, the contact spring 7 is connected to the second terminal 6 at a further end part (upper end of the main piece 700) of the plate spring 70 (see FIG. 4). The second terminal 6 includes a terminal piece 60, a fixing piece 61, an inclined piece 62, and an interconnection piece 63, which are formed integrally by use of metal. The terminal piece 60 is in a rectangular flat plate shape, and includes a screw hole 600 penetrating through its center. A terminal screw is screwed into the screw hole 600.

The fixing piece 61 is in a rectangular flat plate shape, and the further end (upper end) of the plate spring 70 of the contact spring 7 is fixed (swaged) to the fixing piece 61. The inclined piece 62 is in a rectangular flat plate shape, and extends obliquely downward (in a left lower direction) from the lower end of the fixing piece 61. The interconnection piece 63 is in a rectangular flat plate shape, and interconnects the upper end of the terminal piece 60 and the lower end of the inclined piece 62.

The fixed contact 3 which is to be in contact with the movable contact 4 is provided to the first terminal 5. The first terminal 5 includes a terminal piece 50, an attachment piece 51, a supporting piece 52, and an interconnection piece 53, which are formed integrally by use of metal. The terminal piece 50 is in a rectangular flat plate shape, and includes a screw hole 500 penetrating through its center. A terminal screw is screwed into the screw hole 500.

The attachment piece 51 is in a rectangular flat plate shape, and the fixed contact 3 is attached to a center of the attachment piece 51. The supporting piece 52 includes: a main piece 520 having the front end connected to the terminal piece 50; and an inclined piece 521 extending obliquely upward from the upper edge of the main piece 520. The interconnection piece 53 is in a rectangular flat plate shape, and interconnects the upper end of the inclined piece 521 and the right end of the attachment piece 51.

The card 13 of the driving block is made of resilient material (e.g., a metal plate), and is fixed to each of the armature 8 and the contact spring 7.

Figure 5:
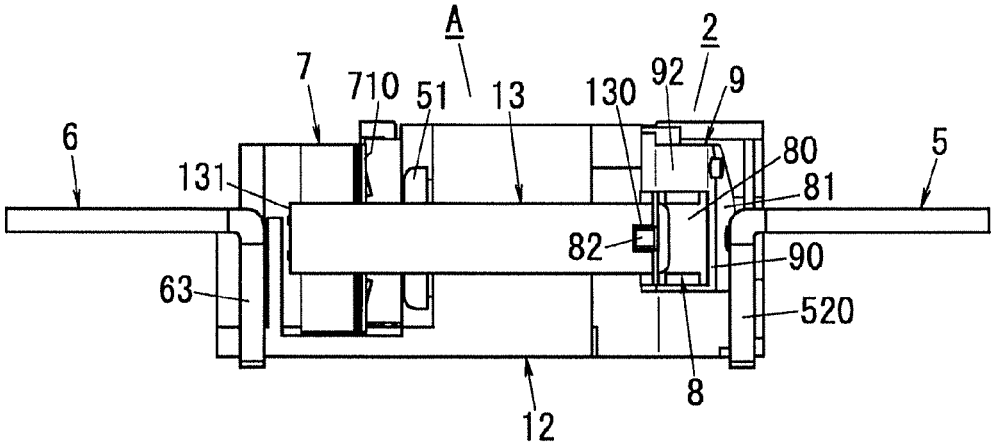
FIG. 5 is a right side view illustrating the relay body of the contact device of the embodiment in accordance with the present invention.

The card 13 is in a band shape as shown in FIG. 5 and FIG. 6, and includes one end in a length direction through which a rectangular hole 130 penetrates, and another end in the length direction bent at the right angle. The card 13 is fixed to the armature 8 by swaging the projection 82 inserted into the hole 130. In other words, the hole 130 defines a first fixing part. Further, in the card 13, the part which is bent at the right angle (hereinafter referred to as a second fixing part 131) is fixed (swaged) to the contact spring 7 (the connection part 712 of the interconnection member 71).

As shown in FIG. 7, the positioning member 12 is a synthetic resin molded product including a bottom wall 120, a first longitudinal wall 121, a second longitudinal wall 122, a third longitudinal wall 123, a fourth longitudinal wall 124, and a fifth longitudinal wall 125 which are formed integrally.

The bottom wall 120 is in a flat hook shape. The first longitudinal wall 121 to the fifth longitudinal wall 125 are in an almost rectangular flat plate shape, and extend in the same direction from a surface of the bottom wall 120. The first longitudinal wall 121, the second longitudinal wall 122, and the third longitudinal wall 123 are arranged in parallel with each other at intervals on a narrow part of the bottom wall 120.

Note that, a space between the first longitudinal wall 121 and the second longitudinal wall 122 is defined as a first groove 126, and a space between the second longitudinal wall 122 and the third longitudinal wall 123 is defined as a second groove 127. The fourth longitudinal wall 124 and the fifth longitudinal wall 125 are arranged in parallel with each other at an interval on an end of a broad part of the bottom wall 120. Note that, a space between the fourth longitudinal wall 124 and the fifth longitudinal wall 125 is defined as a third groove 128.

Further, with regard to the bottom wall 120, a pair of holding holes (first holding holes) 1260 are arranged in a length direction of the first groove 126 in a bottom of the first groove 126. Further, with regard to the bottom wall 120, a pair of holding holes (second holding holes) 1270 are arranged in a length direction of the second groove 127 in a bottom of the second groove 127. Furthermore, with regard to the bottom wall 120, a pair of holding holes (third holding holes) 1280 are arranged in a length direction of the third groove 128 in a bottom of the third groove 128.

Each of the pair of first holding holes 1260, the pair of second holding holes 1270, and the pair of third holding holes 1280 is a rectangular through hole penetrating through the bottom wall 120. Note that, protrusions are provided to an inner circumferential surface of each of the first holding holes 1260, the second holding holes 1270, and the third holding holes 1280.

The main piece 221 of the heel piece 22 constituting the driver 2 is inserted into the first groove 126. This main piece 221 includes a pair of protrusions. The pair of protrusions are pressed into the first holding holes 1260, and thereby the main piece 221 of the heel piece 22 is held and positioned in the first groove 126 (see FIG. 4).

Further, the interconnection piece 53 of the first terminal 5 is inserted into the second groove 127. The interconnection piece 53 also includes a pair of protrusions 530 (see FIG. 6). The pair of protrusions 530 are pressed into the second holding holes 1270, and thereby the interconnection piece 53 of the first terminal 5 is held and positioned in the second groove 127 (see FIG. 4).

Further, the interconnection piece 63 of the second terminal 6 is inserted into the third groove 128. The interconnection piece 63 also includes a pair of protrusions. The pair of protrusions are pressed into the third holding holes 1280, and thereby the interconnection piece 63 of the second terminal 6 is held and positioned in the third groove 128 (see FIG. 4).

In summary, the positioning member 12 is configured to define a positional relationship between the armature 8, the driver 2, the fixed contact 3, the movable contact 4, the contact spring 7, and the card 13. Further, the driver 2, the first terminal 5, and the second terminal 6 are held by the positioning member 12 to constitute the relay body A.

There are rectangular holes 101A and 101B penetrating through left and right corners of a lower part of a bottom plate 100 of the body 10 respectively. Further, there are multiple protrusions provided to an inner circumferential surface of the left hole 101A. A rear end part of the interconnection piece 63 of the second terminal 6 is inserted into the left hole 101A. Further, a rear end part of the main piece 520 of the first terminal 5 is inserted into the right hole 101B. In short, the relay body A is accommodated in the body 10 while the rear end of the interconnection piece 63 of the second terminal 6 is supported on the body 10 (see FIG. 1).

Further, when the relay body A is accommodated in the body 10, the coil terminals 212 of the driver 2 protrude to an outside of the body 10 through a groove 102 provided to an upper side plate of the body 10 (see FIG. 1). Note that, there is a cuboidal rib 103 which has a length direction parallel to the forward and rearward direction and protrudes outward (upward) from a surface (upper face) of the side plate.

In the body 10, there is an arc extinguishing member placed inside a space surrounded by the driver 2, the armature 8, contacts (the fixed contact 3 and the movable contact 4), and the card 13. The arc extinguishing member is constituted by a permanent magnet 14 and a yoke 15. The permanent magnet 14 is in a rectangular flat plate shape, and is magnetized to have different poles in a thickness direction. In the forward and rearward direction, the yoke 15 is in an L-shape. The permanent magnet 14 and the yoke 15 are accommodated in an accommodation part 104 provided to the body 10.

The accommodation part 104 is in a box shape whose outer shape is an L-shape in the forward and rearward direction, and protrudes forward from the bottom plate 100 of the body 10 (see FIG. 2). Further, the accommodation part 104 is hollow, and therefore the permanent magnet 14 and the yoke 15 are inserted into the accommodation part 104 through an insertion opening 1040 formed in a rear side of the body 10 and are accommodated (see FIG. 3).

Next, a process of assembling the contact device of the present embodiment is briefly described.

First, the second fixing part 131 of the card 13 is engaged with the connection part 712 of the contact spring 7, and thereafter the driver 2, the first terminal 5, and the second terminal 6 are held by the positioning member 12. Thereafter, the first fixing part (hole 130) of the card 13 is engaged with the projection 82 of the armature 8, and thereby the relay body A is assembled.

Subsequently, the relay body A is accommodated in the body 10. At this time, the rear end part of the interconnection piece 63 of the second terminal 6 is pressed into the hole 101A of the bottom plate 100 of the body 10, and thereby the relay body A is positioned and fixed to the body 10. Further, by covering the cover 11 with the body 10 from front, the case 1 is assembled. At last, the permanent magnet 14 and the yoke 15 are accommodated in the accommodation part 104 of the body 10, and thereby assembling of the contact device of the present embodiment is completed.

Note that, there are cut-outs 111 formed in left and right side walls of the cover 11 to allow the terminal piece 50 of the first terminal 5 and the terminal piece 60 of the second terminal 6 to protrude outside (see FIG. 2 and FIG. 3). Further, there is a groove 112 in an upper side wall of the cover 11, and this groove 112 receives the rib 103 of the body 10 (see FIG. 3).

Next, operation of the contact device of the present embodiment is described with reference to FIG. 1.

While no voltage is applied between the coil terminals 212, the driver 2 does not operate the armature 8. Therefore, the contact spring 7 is not pulled by the card 13, and the movable contact 4 and the fixed contact 3 face each other to form a predetermined gap therebetween. At this time, the first terminal 5 and the second terminal 6 are in a non conduction state (off-state).

In contrast, while a voltage is applied between the coil terminals 212, the driver 2 operates the armature 8, and the armature 8 rotates counterclockwise. Therefore, the contact spring 7 is pulled by the card 13 and is bent in a right direction. Therefore, the movable contact 4 is in contact with the fixed contact 3. At this time, the first terminal 5 and the second terminal 6 are in a conduction state (on-state).

Note that, when a voltage is not applied between the coil terminals 212 in the on-state, the armature 8 rotates clockwise, and the contact device returns to the off-state.

When the contact returns from the on-state to the off-state, arc discharge may occur between the movable contact 4 and the fixed contact 3. When arc discharge occurs, it is necessary to extinguish the resultant arc in order to end arc discharge in short time.

In view of this, the contact device of the present embodiment accommodates, in the accommodation part 104 of the body 10, the arc extinguishing member constituted by the permanent magnet 14 and the yoke 15. In more details, the permanent magnet 14 and the yoke 15 form a magnetic field around the fixed contact 3 and the movable contact 4, and thereby an arc is elongated by electromagnetic force caused by the magnetic field, and this results in extinguishment of the arc.

As described above, in the contact device of the present embodiment, the card 13 is made of resilient material, and is fixed to each of the armature 8 and the contact spring 7. Therefore, in contrast to a case where the card 13 is slidably caught by the armature 8 and the contact spring 7, abrasion powder caused by slide does not occur. Consequently, in contrast to the conventional example in which abrasion powder caused by slide is likely to occur, the contact device of the present embodiment can offer improvement of reliability.

Note that, in the relay body A, the armature 8 turns around a fulcrum defined by a contact point of the armature 8 and the heel piece 22, and the contact spring 7 turns around a fulcrum defined by a part of the contact spring 7 fixed to the second terminal 6. Hence, the card 13 moves in parallel in the length direction (left and right direction), and further moves in the thickness direction (upward and downward direction).

Further, a turning radius of the armature 8 is different from a turning radius of the contact spring 7, an amount of movement of the card 13 in the thickness direction is different between at an end close to the first fixing part 130 and at an end close to the second fixing part 131. A difference between the amounts of the movement may cause forces in the thickness direction at the both ends of the card 13, and therefore the card 13 may receive stress.

In view of this, in the contact device of the present embodiment, it is preferable that the card 13 be more flexible in a direction (the thickness direction of the card 13) perpendicular to a contact and separation direction (the length direction of the card 13) of the movable contact 4 with regard to the fixed contact 3 than in the contact and separation direction. Even if there is a difference between amounts of movement at the both ends of the card 13, the card 13 is more flexible in the thickness direction, and therefore forces occurring at the both ends of the card 13 caused by the difference between the amounts of movement and stress occurring in the card 13 can be reduced.

Further, in the contact device of the present embodiment, it is preferable that the card 13 be placed so as to extend across the contact spring 7 in the contact and separation direction, and fixed to an opposite side (left side) of the contact spring 7 from the armature 8 in the contact and separation direction. In more detail, the card 13 in the present embodiment is swaged to the opposite side (left side) of the contact spring 7 (the connection part 712 of the interconnection member 71) from the armature 8 at the second fixing part 131.

The second fixing part 131 is fixed relative to the connection part 712 in the thickness direction, and therefore the second fixing part 131 can be easily fixed to the connection part 712 which is relatively thin. Alternatively, the card 13 may be placed so as to extend across the armature 8 in the contact and separation direction, and be fixed to an opposite side (right side) of the armature 8 from the contact spring 7 in the contact and separation direction.

Note that, the dimension in the length direction (left and right direction) of the card 13 is determined based on a distance between an end of the armature 8 fixed to the first fixing part 130 of the card 13 and an end of the contact spring 7 fixed to the second fixing part 131 of the card 13. As apparent from the above, the dimension in the length direction of the card 13 decreases with a decrease in the above distance. However, the card 13 is in a straight band shape, and hence the card 13 becomes less flexible in the thickness direction as the dimension in the length direction decreases.

Figure 8:
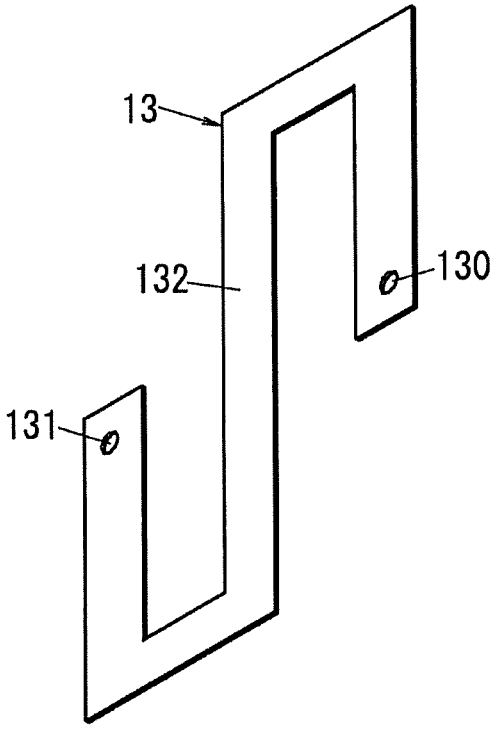
FIG. 8 is a perspective view illustrating another configuration of the card of the contact device of the embodiment in accordance with the present invention.
Figure 9:
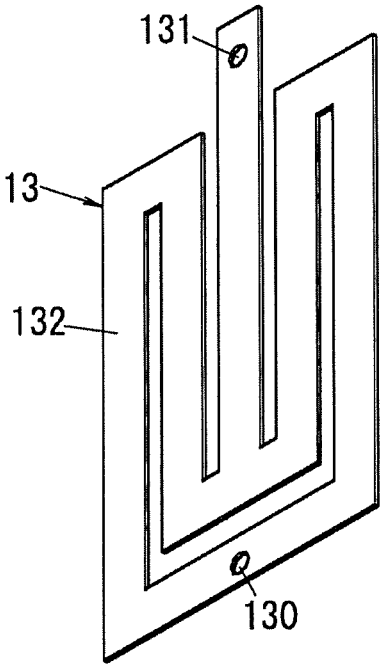
FIG. 9 is a perspective view illustrating another configuration of the card of the contact device of the embodiment in accordance with the present invention.
Figure 10:
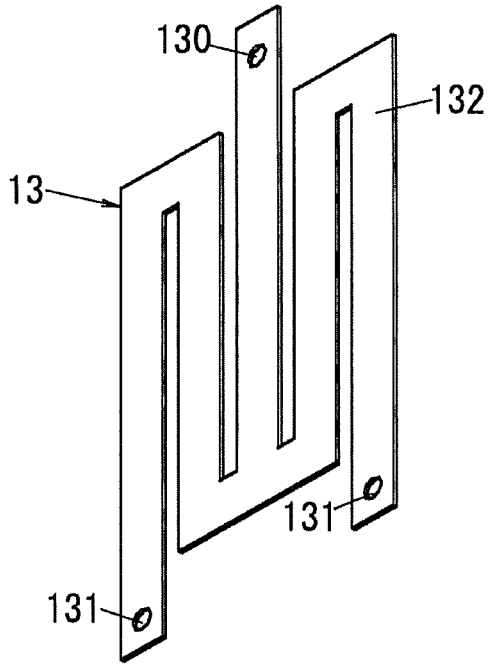
FIG. 10 is a perspective view illustrating another configuration of the card of the contact device of the embodiment in accordance with the present invention.
Figure 11:
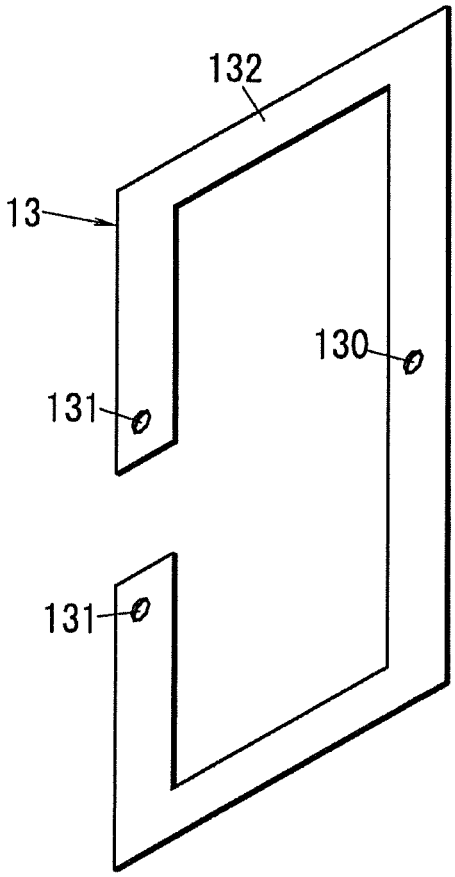
FIG. 11 is a perspective view illustrating another configuration of the card of the contact device of the embodiment in accordance with the present invention.
Figure 12:
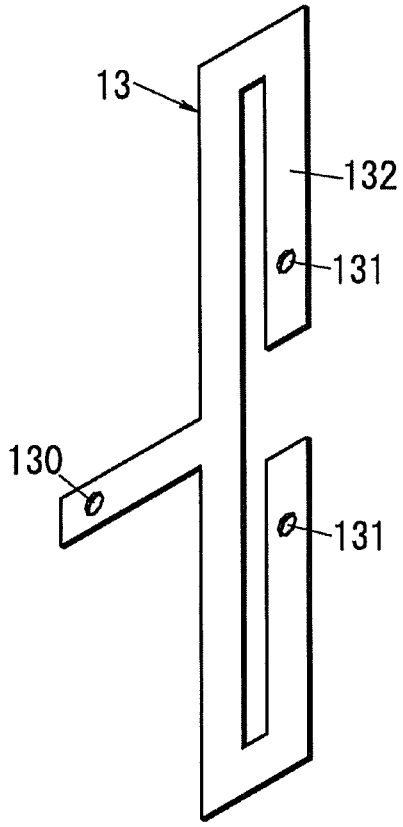
FIG. 12 is a perspective view illustrating another configuration of the card of the contact device of the embodiment in accordance with the present invention.
Figure 13:
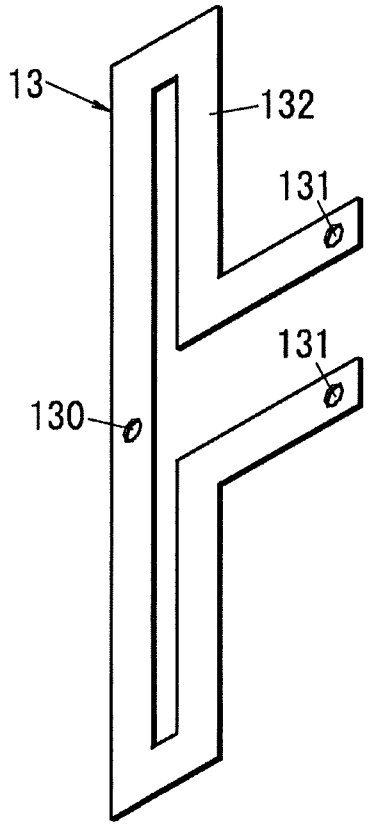
FIG. 13 is a perspective view illustrating another configuration of the card of the contact device of the embodiment in accordance with the present invention.

In view of this, it is preferable that the card 13 be configured so that the interconnection part 132 interconnecting the first fixing part 130 and the second fixing part 131 is longer than a shortest distance between the first fixing part 130 and the second fixing part 131 (see FIG. 8). When the card 13 is configured like above, it is possible to prevent the card 13 from becoming less flexible in the thickness direction even when the distance between the first fixing part 130 and the second fixing part 131 is shortened.

Alternatively, as shown in FIG. 8 to FIG. 13, it is preferable that a whole of the interconnection part 132 be inside a space between the first fixing part 130 and the second fixing part 131 in the contact and separation direction. When the interconnection part 132 is configured like above, the card 13 can be downsized in the contact and separation direction.

Figure 14:
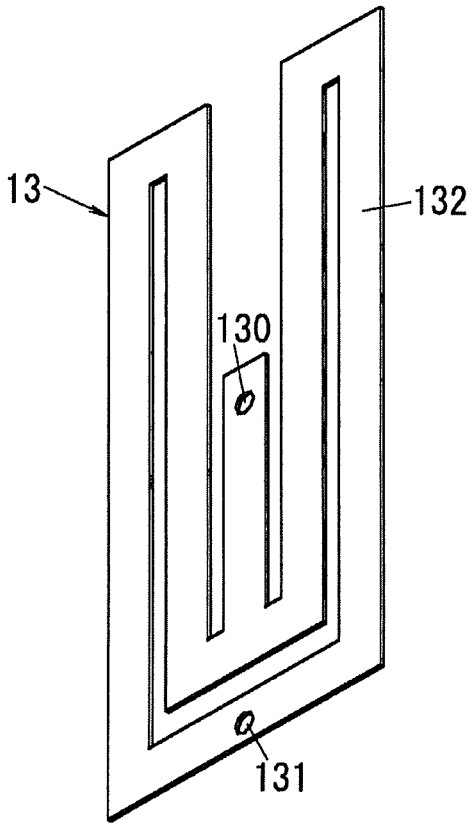
FIG. 14 is a perspective view illustrating another configuration of the card of the contact device of the embodiment in accordance with the present invention.
Figure 15:
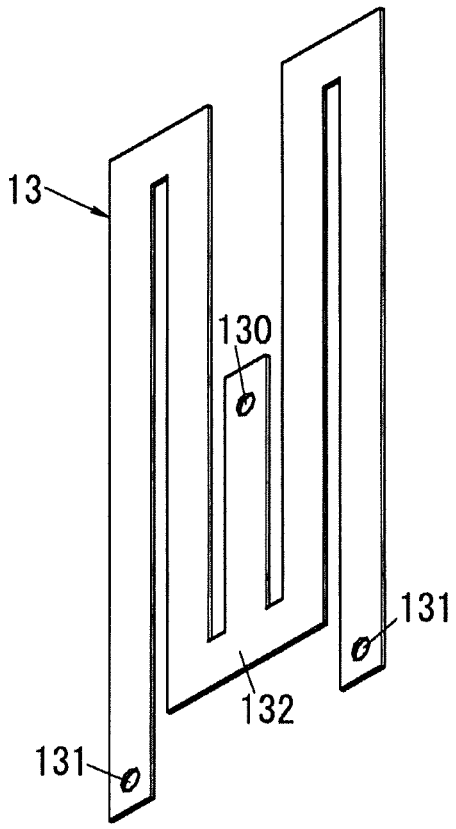
FIG. 15 is a perspective view illustrating another configuration of the card of the contact device of the embodiment in accordance with the present invention.
Figure 16:
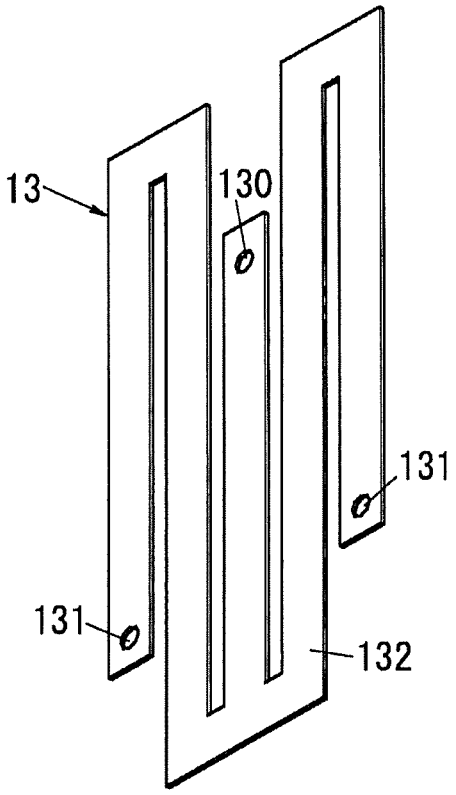
FIG. 16 is a perspective view illustrating another configuration of the card of the contact device of the embodiment in accordance with the present invention.

Alternatively, as shown in FIG. 14 to FIG. 16, it is preferable that at least part of the interconnection part 132 be outside a space between the first fixing part 130 and the second fixing part 131 in the contact and separation direction. When the interconnection part 132 is configured like above, the card 13 can be downsized in multiple directions including the contact and separation direction.

Figure 17:
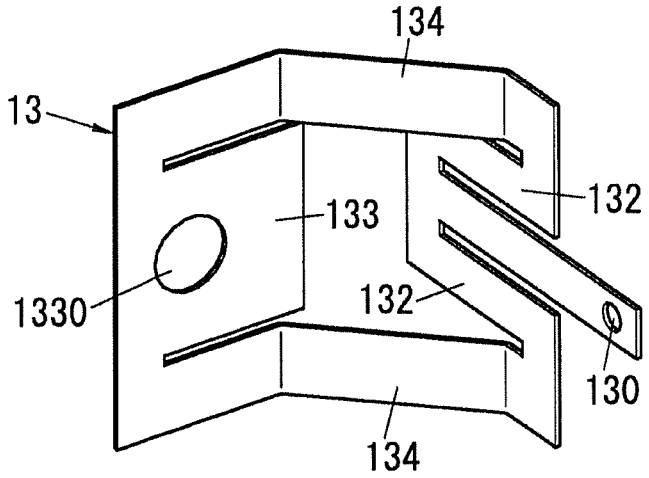
FIG. 17 is a perspective view illustrating another configuration of the card of the contact device of the embodiment in accordance with the present invention.
Figure 18:
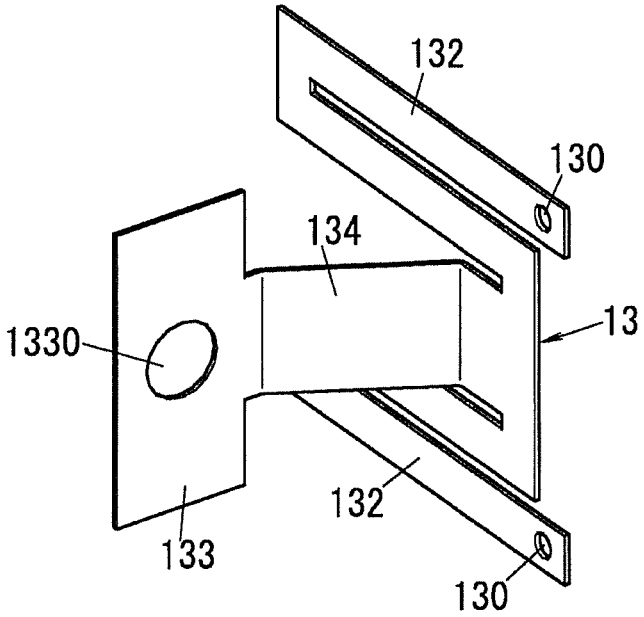
FIG. 18 is a perspective view illustrating another configuration of the card of the contact device of the embodiment in accordance with the present invention.

In this regard, as shown in FIG. 17 and FIG. 18, the card 13 may include a contact pressure part flexible in a contact and separation direction of the movable contact 4, and be fixed to the contact spring 7 at this contact pressure part. Note that, this contact pressure part is constituted by a fixing piece 133 which is flat and fixed to the contact spring 7 and a flexible piece 134 connecting the pair of interconnection parts 132 to the fixing piece 133. While the flexible piece 134 is bent, this contact pressure part causes a force to press the movable contact 4 against the fixed contact 3.

In a case where, instead of the interconnection member 71 of the contact spring 7, the fixing piece 133 of the contact pressure part is fixed to the attachment piece 702 of the plate spring 70, an operation process of swaging the second fixing part 131 to the interconnection member 71 can be omitted, and also the interconnection member 71 can be omitted. Note that, a through hole 1330 provided to the fixing piece 133 of the contact pressure part is used for swaging of the movable contact 4.

As described above, the contact device of the first aspect in accordance with the present invention includes an armature 8, a driver 2, a fixed contact 3, a movable contact 4, a contact spring 7, and a card 13. The driver 2 is for driving the armature 8. The movable contact 4 is to be in contact with and separate from the fixed contact 3. The contact spring 7 is for holding the movable contact 4 so as to allow the movable contact 4 to be in contact with and separate from the fixed contact 3. The card 13 interconnects the armature 8 and the contact spring 7. The card 13 is made of resilient material and is fixed to each of the armature 8 and the contact spring 7.

In the contact device of the second aspect in accordance with the present invention, realized in combination with the first aspect, the card 13 is more flexible in a direction perpendicular to a contact and separation direction of the movable contact 4 than in the contact and separation direction.

In the contact device of the third aspect in accordance with the present invention, realized in combination with the first or second aspect, the card 13 is placed so as to extend across at least one of the armature 8 and the contact spring 7 in a contact and separation direction of the movable contact 4. The card 13 is fixed to opposite sides of the armature 8 and the contact spring 7 from each other in the contact and separation direction.

In the contact device of the fourth aspect in accordance with the present invention, realized in combination with the second or third aspect, the card 13 includes a first fixing part (hole 130) fixed to the armature 8, a second fixing part 131 fixed to the contact spring 7, and an interconnection part 132 interconnecting the first fixing part and the second fixing part 131. The interconnection part 132 is longer than a shortest distance between the first fixing part and the second fixing part 131.

In the contact device of the fifth aspect in accordance with the present invention, realized in combination with the fourth aspect, a whole of the interconnection part 132 is inside a space between the first fixing part and the second fixing part 131 in the contact and separation direction.

In the contact device of the sixth aspect in accordance with the present invention, realized in combination with the fourth aspect, at least part of the interconnection part 132 is outside a space between the first fixing part and the second fixing part 131 in the contact and separation direction.

In the contact device of the seventh aspect in accordance with the present invention, realized in combination with any one of the first to sixth aspects, the card 13 includes a contact pressure part (the fixing piece 133 and the flexible piece 134) flexible in a contact and separation direction of the movable contact 4, and is fixed to the contact spring 7 at this contact pressure part.

In the contact device of the eighth aspect in accordance with the present invention, realized in combination with any one of the first to seventh aspects, the card 13 is made of metal.

The invention claimed is:

1. A contact device, comprising:

an armature;

a driver for driving the armature;

a fixed contact;

a movable contact to be in contact with and separate from the fixed contact;

a contact spring for holding the movable contact so as to allow the movable contact to be in contact with and separate from the fixed contact; and a card being made of a metal plate in a band shape and including a first fixing part fixed to the armature, a second fixing part fixed to the contact spring, and an interconnection part interconnecting the first fixing part and the second fixing part, the first fixing part and the second fixing part being provided to one end and another end in a length direction of the card, respectively, and the card being configured to be more flexible in a thickness direction of the card perpendicular to a contact and separation direction of the movable contact than in the length direction of the card along the contact and separation direction.

2. The contact device according to claim 1, wherein the card is placed so as to extend across at least one of the armature and the contact spring in a contact and separation direction of the movable contact, and is fixed to opposite sides of the armature and the contact spring from each other in the contact and separation direction.

3. The contact device according to claim 1, wherein:

the interconnection part is longer than a shortest distance between the first fixing part and the second fixing part.

4. The contact device according to claim 3, wherein a whole of the interconnection part is inside a space between the first fixing part and the second fixing part in the contact and separation direction.

5. The contact device according to claim 3, wherein at least part of the interconnection part is outside a space between the first fixing part and the second fixing part in the contact and separation direction.

6. The contact device according to claim 1, wherein the card includes a contact pressure part flexible in a contact and separation direction of the movable contact, and is fixed to the contact spring at this contact pressure part.

* * * * *